US006641134B1

(12) United States Patent
Dobbertin et al.

(10) Patent No.: US 6,641,134 B1
(45) Date of Patent: Nov. 4, 2003

(54) SYSTEM AND METHOD FOR IMPROVED REGISTRATION PERFORMANCE

(75) Inventors: Michael T. Dobbertin, Honeoye, NY (US); Timothy J. Young, Williamson, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 158 days.

(21) Appl. No.: 09/698,512

(22) Filed: Oct. 27, 2000

(51) Int. Cl.[7] ..... B65H 9/00

(52) U.S. Cl. ..... 271/226; 271/270; 271/264; 271/265.01; 399/396

(58) Field of Search ..... 271/226, 270, 271/264, 265.01, 265.02; 399/394, 395, 396, 381, 388, 302

(56) References Cited

U.S. PATENT DOCUMENTS

| | | | | |
|---|---|---|---|---|
| 4,519,700 A | | 5/1985 | Barker et al. | |
| 4,591,969 A | * | 5/1986 | Bloom et al. | 318/603 |
| 5,094,442 A | | 3/1992 | Kamprath et al. | 271/227 |
| 5,278,624 A | | 1/1994 | Kamprath et al. | |
| 5,322,273 A | | 6/1994 | Rapkin et al. | |
| 5,731,680 A | * | 3/1998 | Winterberger et al. | 271/226 |
| 5,794,176 A | * | 8/1998 | Milillo | 271/228 |
| 6,141,525 A | * | 10/2000 | Tahara | 399/303 |
| 6,327,458 B1 | * | 12/2001 | Chapman | 399/302 |
| 6,342,909 B1 | * | 1/2002 | Joichi et al. | 347/129 |
| 6,374,075 B1 | * | 4/2002 | Benedict et al. | 399/394 |

FOREIGN PATENT DOCUMENTS

DE 198 45 353 4/2000

OTHER PUBLICATIONS

European Search Report No. EP 01 12 4278, dated May 10, 2002 with cited referenced which appear on p. 1 of this statement.

* cited by examiner

*Primary Examiner*—Patrick Mackey

(57) ABSTRACT

An apparatus and method for advancing a receiver into registered relationship with a moving image-bearing member. A motor is provided that is responsive to motor drive pulses. A drive member engages the receiver, and a drive coupling connects the drive member and the motor. An encoder generates encoder pulses that correspond with movement of the image-bearing member. A pulse generator generates motor drive pulses in response to the encoder pulses to accelerate the receiver to a speed approximately equal to the speed of the image-bearing member speed. A timer determines an amount of delay time between detection of the receiver by an in-track sensor and the beginning of a subsequent movement of the motor. A delay mechanism delays the acceleration of the receiver to the image-bearing member speed by the amount of delay time.

18 Claims, 10 Drawing Sheets

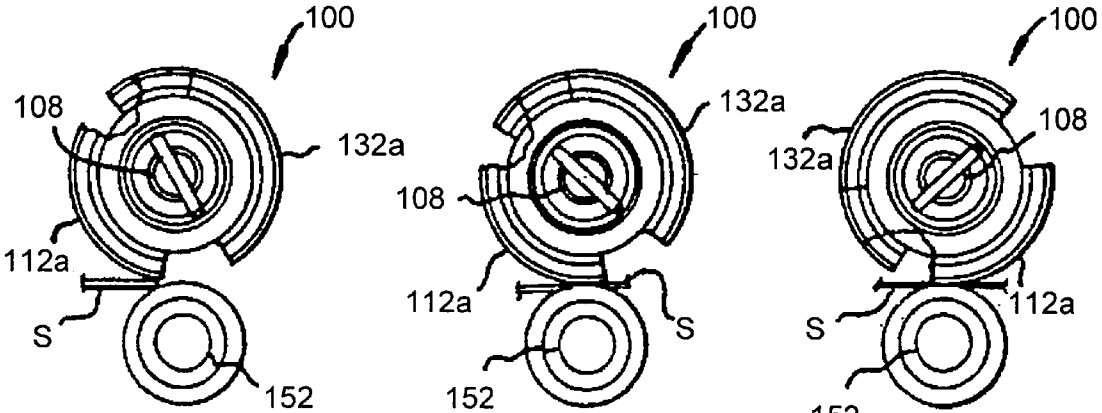
FIG. 7a
FIG. 7b
FIG. 7c
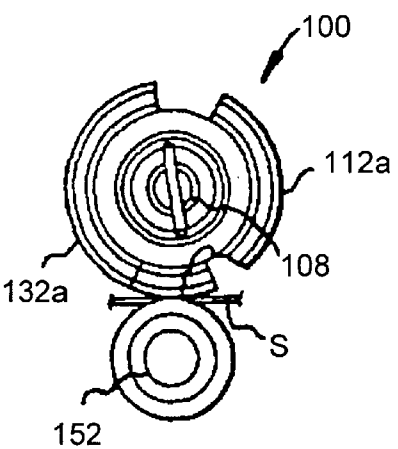
FIG. 7d
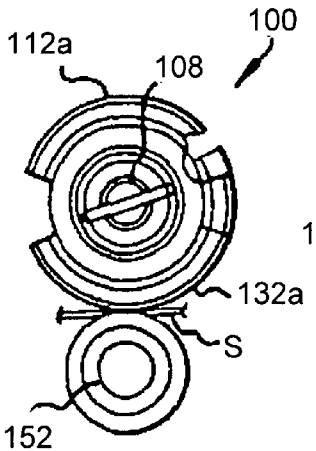
FIG. 7e
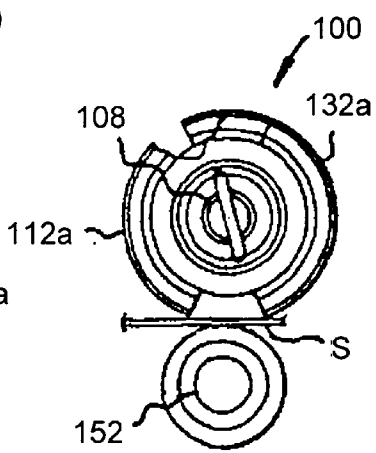
FIG. 7f

SYSTEM AND METHOD FOR IMPROVED REGISTRATION PERFORMANCE

BACKGROUND OF THE INVENTION

1. Field of the Invention

This invention relates to electrophotographic reproduction apparatus and methods for registering sheets and more particularly to apparatus and methods for control of a stepper motor drive for controlling movement of a receiver sheet into transfer relationship with an image-bearing member that supports an image to be transferred to the receiver sheet.

2. Brief Description of Available Systems

In known electrophotographic copier, printers or duplicators the problem of accurate registration of a receiver sheet with a moving member supporting an image for transfer to the sheet is well known. In this regard, reference is made to U.S. Pat. No. 5,322,273, the contents of which are incorporated herein by reference.

Typically, an electrophotographic latent image is formed on the member and this image is toned and then transferred to a receiver sheet directly or transferred to an intermediate image-bearing member and then to the receiver sheet. In moving of the receiver sheet into transfer relationship with the image-bearing member, it is important to adjust the sheet for skew. Once the skew of the sheet is corrected, it is advanced by rollers driven by stepper motors towards the image-bearing member. During the skew control adjustment, the adjustment is implemented by selectively driving the stepper motor driven rollers, which are controlled independently of movement of the image-bearing member. Typically, movement of the receiver sheet and operations performed thereon by various stations are controlled using one or more encoders. Known registration control systems use a transfer roller with which an encoder wheel is associated. This encoder is used for controlling registration of the sheet. At some point in time after adjustment of the sheet for skew and prior to engagement of the sheet into transfer relationship with the image-bearing member, the control of the stepper motors that provide the drive to the rollers which advance the sheet, is transferred from simulated clock pulses of a microprocessor to the actual clocking pulses generated by the encoder wheel.

A problem with these systems is that in switching control of the stepper motors from synchronization with control signals in the skew correction device to that of the encoder wheel, a stepper motor driving pulse may be lost. This results in sufficient positional difference between receiver sheet and photoconductive belt that accurate registration is not accomplished.

An improved registration apparatus is disclosed in U.S. Pat. No. 5,731,680, the contents of which are incorporated herein by reference. However, even this improved apparatus relies upon a transfer of stepper motor control from simulated clock pulses to the clocking pulses generated by the encoder wheel. The relatively low resolution of the encoder wheels traditionally used in registration systems limits the precision that can be achieved during the transfer of stepper motor control. It is, therefore, an object of the invention to provide improved methods and apparatus for ensuring accurate registration of the receiver sheet and image-bearing member.

BRIEF SUMMARY OF THE PREFERRED EMBODIMENTS

In accordance with one aspect of the invention, there is provided an apparatus for advancing a receiver sheet into registered relationship with a moving image-bearing member. The apparatus includes a drive member that engages the receiver. A motor, which is responsive to motor drive pulses, is coupled to the drive member. The apparatus also includes an encoder that generates encoder pulses that correspond with movement of the image-bearing member. A pulse generator is provided to generate motor drive pulses. The pulse generator is connected to the motor for accelerating the receiver sheet to a speed approximately equal to the speed of the image-bearing member.

In accordance with another aspect of the invention, there is provided a method for advancing a sheet into registered relationship with a moving image-bearing member. An encoder is provided that tracks the movement of the image-bearing member. A motor is also provided. The motor is then driven in response to an output of the encoder to accelerate the receiver movement to a speed substantially equal to the speed of the image-bearing member.

The invention and its various advantages will become more apparent to those skilled in the art from the ensuing detailed description of preferred embodiments, reference being made to the accompanying drawings.

BRIEF DESCRIPTION OF THE DRAWINGS

The subsequent description of the preferred embodiments of the present invention refers to the attached drawings, wherein:

FIGS. 7*a*–7*f* are respective side elevational views of the urging rollers of the sheet registration mechanism of FIG. 1 at various time intervals in the operation of the sheet registration mechanism;

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
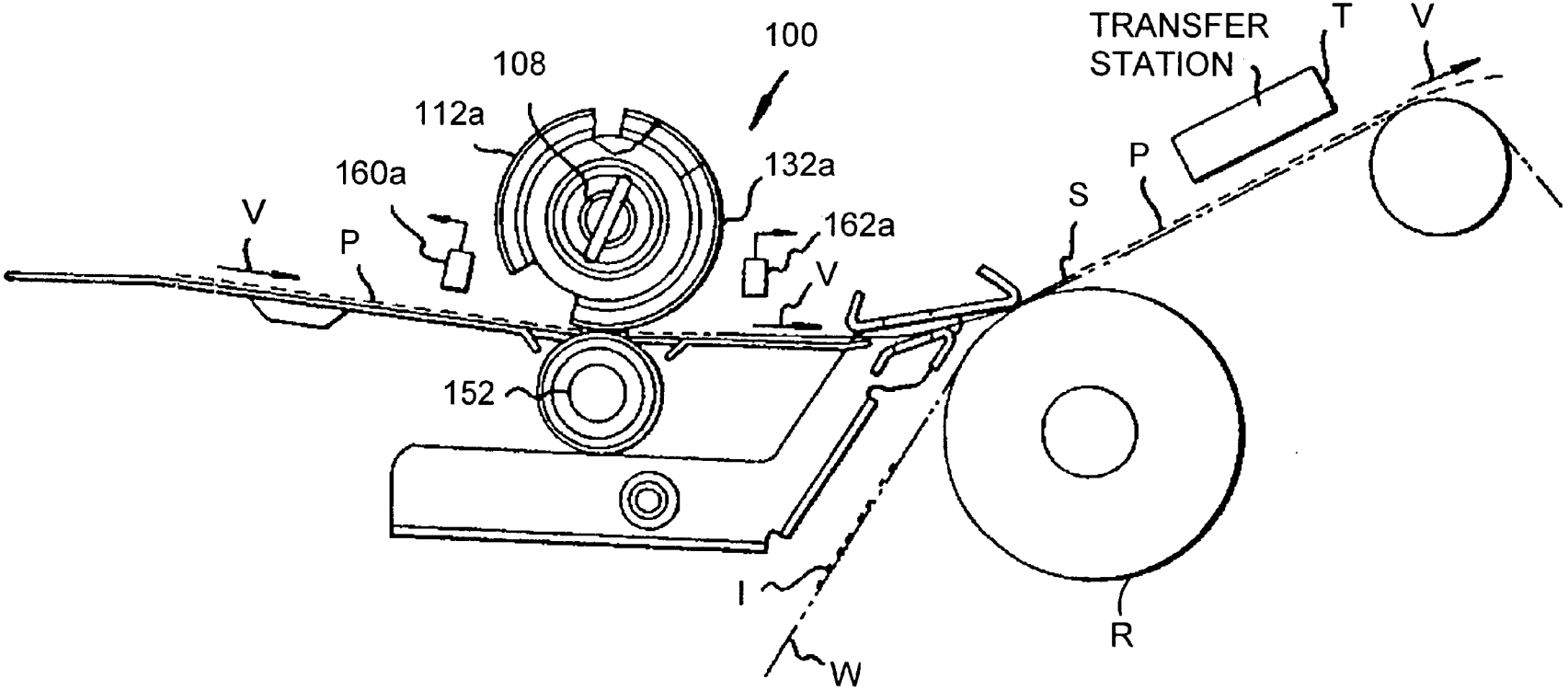
FIG. 1 is a side elevational view of a sheet registration mechanism, partly in cross-section, and with portions removed to facilitate viewing.
Figure 2:
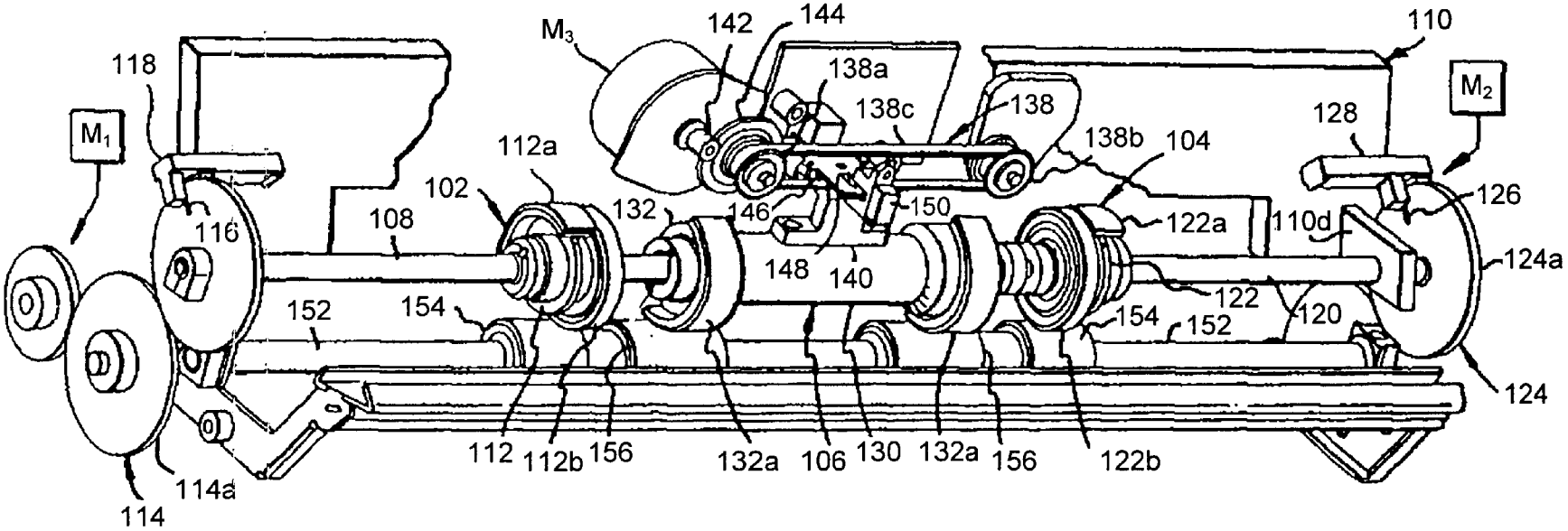
FIG. 2 is a view, in perspective, of the sheet registration mechanism of FIG. 1, with portions removed or broken away to facilitate viewing.
Figure 3:
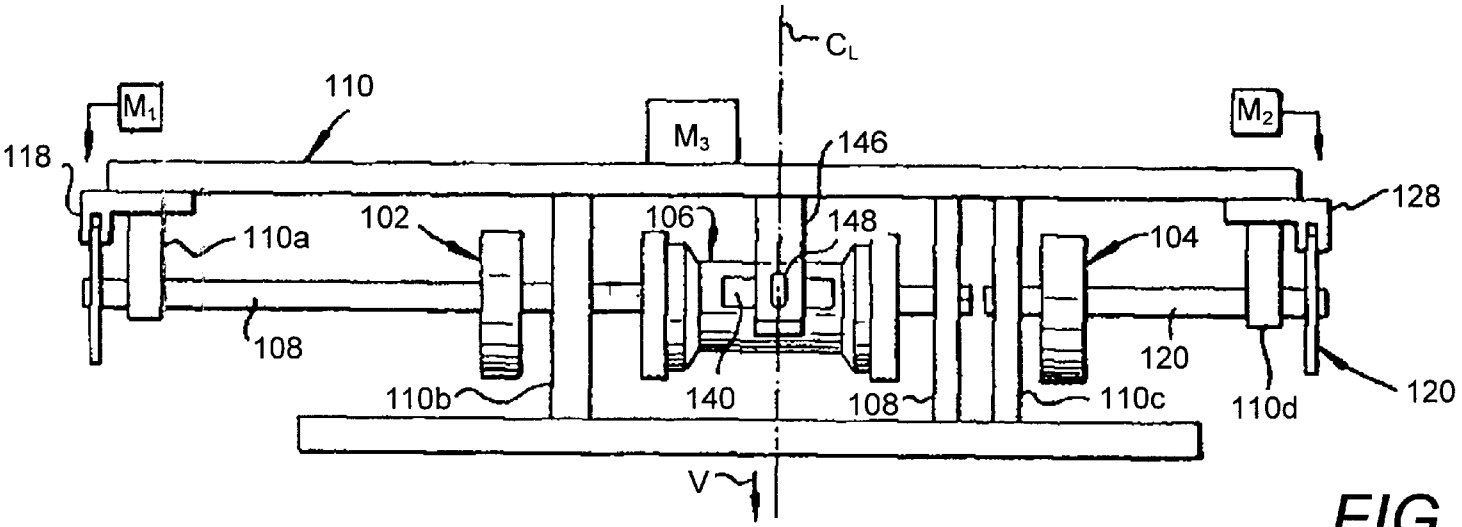
FIG. 3 is a top plan view of the sheet registration mechanism of FIG. 1, with portions removed or broken away to facilitate viewing.

Referring now to the accompanying drawings, FIGS. 1–3 best show the sheet registration mechanism, designated generally by the numeral 100, according to this invention. The sheet registration mechanism 100 is located in association with a substantially planar sheet transport path P of any well known device where sheets are transported seriatim from a supply (not shown) to a station where an operation is performed on the respective sheets. For example, the device may be a reproduction apparatus, such as a copier or printer or the like, where marking particle developed images of original information, are placed on receiver sheets. As shown in FIG. 1, the marking particle developed images (e.g., image I) are transferred at a transfer station T from an image-bearing member such as a movable web or drum (e.g., web W) to a sheet of receiver material (e.g., a cut sheet S of plain paper or transparency material) moving along the path P. A transfer roller R guides the web W.

In reproduction apparatus of the above type, it is desired that the sheet S be properly registered with respect to a marking particle developed image in order for the image to be placed on the sheet in an orientation to form a suitable reproduction for user acceptability. Accordingly, the sheet registration mechanism 100 provides for alignment of the receiver sheet in a plurality of orthogonal directions. That is, the sheet is aligned, with the marking particle developed image, by the sheet registration mechanism by removing any skew in the sheet (angular deviation relative to the image), and moving the sheet in a cross-track direction so that the centerline of the sheet in the direction of sheet travel and the centerline of the marking particle image are coincident. Further, the sheet registration mechanism 100 times the advancement of the sheet along the path P such that the sheet and the marking particle image are aligned in the in-track direction as the sheet travels through the transfer station T.

In order to accomplish skew correction and cross-track and in-track alignment of the receiver with respect to the image-bearing member, one or more drive members are operable to engage the receiver. For example, to register the sheet S with respect to a marking particle developed image on the moving web W, the sheet registration apparatus 100 includes first and second independently driven roller assemblies 102, 104, and a third roller assembly 106. The first roller assembly 102 includes a first shaft 108 supported adjacent its ends in bearings 110*a*, 110*b* mounted on a frame 110. Support for the first shaft 108 is selected such that the first shaft is located with its longitudinal axis lying in a plane parallel to the plane through the sheet transport path P and substantially perpendicular to the direction of a sheet traveling along the transport path in the direction of arrows V (FIG. 1). A first urging drive roller 112 is mounted on the first shaft 108 for rotation therewith. The urging roller 112 has an arcuate peripheral segment 112*a* extending about 180° around such roller. The peripheral segment 112*a* has a radius to its surface measured from the longitudinal axis of the first shaft 108 substantially equal to the minimum distance of such longitudinal axis from the plane of the transport path P.

One or more motors are operable to drive the drive members via a drive coupling. For example, a first stepper motor $M_1$, mounted on the frame 110, is operatively coupled to the first shaft 108 through a gear train 114 to rotate the first shaft when the motor is activated. The gear 114*a* of the gear train 114 incorporates an indicia 116 detectable by a suitable sensor mechanism 118. The sensor mechanism 118 can be either optical or mechanical depending upon the selected indicia. Location of the sensor mechanism 118 is selected such that when the indicia 116 is detected, the first shaft 108 will be angularly oriented to position the first urging roller 112 in a home position. The home position of the first urging roller is that angular orientation where the surface of the arcuate peripheral segment 112*a* of the roller 112, upon further rotation of the shaft 108, will contact a sheet in the transport path P (see FIG. 7*a*).

The second roller assembly 104 includes a second shaft 120 supported adjacent its ends in bearings 110*c*, 110*d* mounted on the frame 110. Support of the second shaft 120 is selected such that the second shaft is located with its longitudinal axis lying in a plane parallel to the plane through the sheet transport path P and substantially perpendicular to the direction of a sheet traveling along the transport path. Further, the longitudinal axis of the second shaft 120 is substantially coaxial with the longitudinal axis of the first shaft 108.

A second urging drive roller 122 is mounted on the second shaft 120 for rotation therewith. The urging roller 122 has an arcuate peripheral segment 122*a* extending about 180° around such roller. The peripheral segment 122*a* has a radius to its surface measured from the longitudinal axis of the first shaft 108 substantially equal to the minimum distance of such longitudinal axis from the plane of the transport path P. The arcuate peripheral segment 122*a* is angularly coincident with the arcuate peripheral segment 112*a* of the urging roller 112. A second independent stepper motor $M_2$, mounted on the frame 110, is operatively coupled to the second shaft 120 through a gear train 124 to rotate the second shaft when the motor is activated. The gear 124*a* of the gear train 124 incorporates an indicia 126 detectable by a suitable sensor mechanism 128. The sensor mechanism 128, adjustably mounted on the frame 110, can be either optical or mechanical depending upon the selected indicia. Location of the sensor mechanism 128 is selected such that when the indicia 126 is detected, the second shaft 120 will be angularly oriented to position the second urging roller 122 in a home position. The home position of the second urging roller is that angular orientation where the surface of the arcuate peripheral segment 122*a* of the roller 122, upon further rotation of the shaft 120, will contact a sheet in the transport path P (same as the angular orientation of the peripheral segment 112*a* as shown in FIG. 7*a*).

Figure 4:
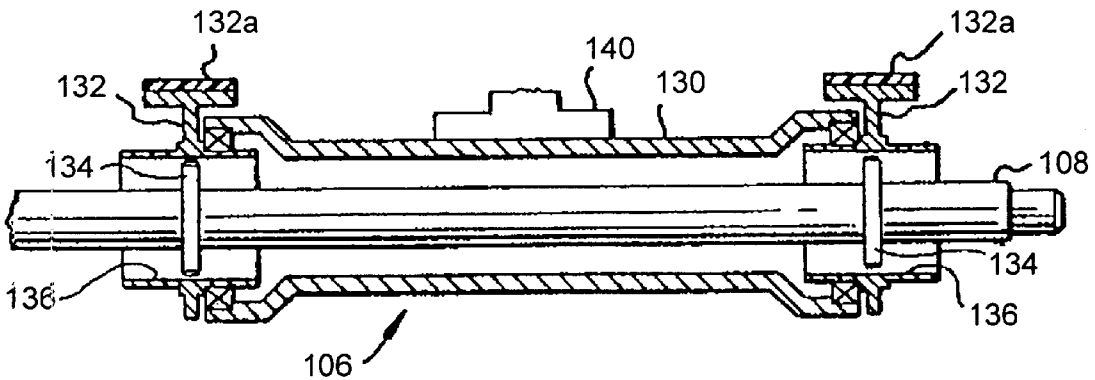
FIG. 4 is a front elevational view, in cross-section of the third roller assembly of the sheet registration mechanism of FIG. 1.

The third roller assembly 106 includes a tube 130 surrounding the first shaft 108 and capable of movement relative to the first shaft in the direction of the longitudinal axis thereof. A pair of third urging drive rollers 132 are mounted on the first shaft 108, supporting the tube 130 for relative rotation with respect to the third urging rollers. The third urging rollers 132 respectively have an arcuate peripheral segment 132*a* extending about 180° around each roller. The peripheral segments 132*a* each have a radius to its respective surface measured from the longitudinal axis of the first shaft 108 substantially equal to the minimum distance of such longitudinal axis from the plane of the transport path P. The arcuate peripheral segments 132*a* are angularly offset with respect to the arcuate peripheral segments 112*a*, 122*a* of the first and second urging rollers. The pair of third urging rollers 132 are coupled to the first shaft 108 by a key or pin 134 engaging a slot 136 in the respective rollers (FIG. 4). Accordingly, the third urging rollers 132 will be rotatably driven with the first shaft 108 when the first shaft is rotated by the first stepper motor $M_1$, and are movable in the direction along the longitudinal axis of the first shaft with the tube 130. For the purpose to be more fully explained below, the angular orientation of the third urging rollers 132 is such that the arcuate peripheral segments 132*a* thereof are offset relative to the arcuate peripheral segments 112*a* and 122*a*.

A third independent stepper motor $M_3$, mounted on the frame 110, is operatively coupled to the tube 130 of the third roller assembly 106 to selectively move the third roller assembly in either direction along the longitudinal axis of the first shaft 108 when the motor is activated. The operative coupling between the third stepper motor $M_3$ and the tube 130 is accomplished through a pulley and belt arrangement 138. The pulley and belt arrangement 138 includes a pair of pulleys 138*a*, 138*b*, rotatably mounted in fixed spatial relation, for example, to a portion of the frame 110. A drive belt 138*c* entrained about the pulleys is connected to a bracket 140 which is in turn connected to the tube 130. A drive shaft 142 of the third stepper motor $M_3$ is drivingly engaged with a gear 144 coaxially coupled to the pulley 138*a*. When the stepper motor $M_3$ is activated, the gear 144 is rotated to rotate the pulley 138*a* to move the belt 138*c* about its closed loop path. Depending upon the direction of rotation of the drive shaft 142, the bracket 140 (and thus the third roller assembly 106) is selectively moved in either direction along the longitudinal axis of the first shaft 108.

A plate 146 connected to the frame 110 incorporates an indicia 148 detectable by a suitable sensor mechanism 150. The sensor mechanism 150, adjustably mounted on the bracket 140, can be either optical or mechanical depending upon the selected indicia. Location of the sensor mechanism 150 is selected such that when the indicia 148 is detected, the third roller assembly 106 is located in a home position. The home position of the third roller assembly 106 is selected such that the third roller assembly is substantially centrally located relative to the cross-track direction of a sheet in the transport path P.

The frame 110 of the sheet registration mechanism 100 also supports a shaft 152 located generally below the plane of the sheet transport path P. Pairs of idler rollers 154 and 156 are mounted on the shaft 152 for free rotation. The rollers of the idler pair 154 are respectively aligned with the first urging roller 112 and the second urging roller 122. The rollers of the idler roller pair 156 are aligned with the respective third urging rollers 132, and extend in a longitudinal direction for a distance sufficient to accommodate for maintaining such alignment over the range of longitudinal movement of the third roller assembly 106. The spacing of the shaft 152 from the plane of the sheet transport path P and the diameter of the respective rollers of the idler roller pairs 154 and 156 are selected such that the rollers will respectively form a nip relation with the arcuate peripheral segments 112*a*, 122*a*, and 132*a* of the urging rollers. For example, the shaft 152 may be spring loaded in a direction urging such shaft toward the shafts 108, 120, where the idler roller pair 154 will engage spacer roller bearings 112*b*, 122*b*.

With the above described construction for the sheet registration mechanism 100 according to this invention, sheets traveling seriatim along the sheet transport path P are alignable by removing any skew (angular deviation) in the sheet to square the sheet up with respect to the path, and moving the sheet in a cross-track direction so that the centerline of the sheet in the direction of sheet travel and the centerline $C_L$ of the transport path P are coincident. Of course, the centerline $C_L$ is arranged to be coincident with the centerline of the downstream operation station (in the illustrated embodiment, the centerline of a marking particle image on the web W). Further, the sheet registration mechanism 100 times the advancement of the sheet along the transport path P for alignment in the in-track direction (again referring to the illustrated embodiment, in register with the lead edge of a marking particle image on the web W).

Figure 8:
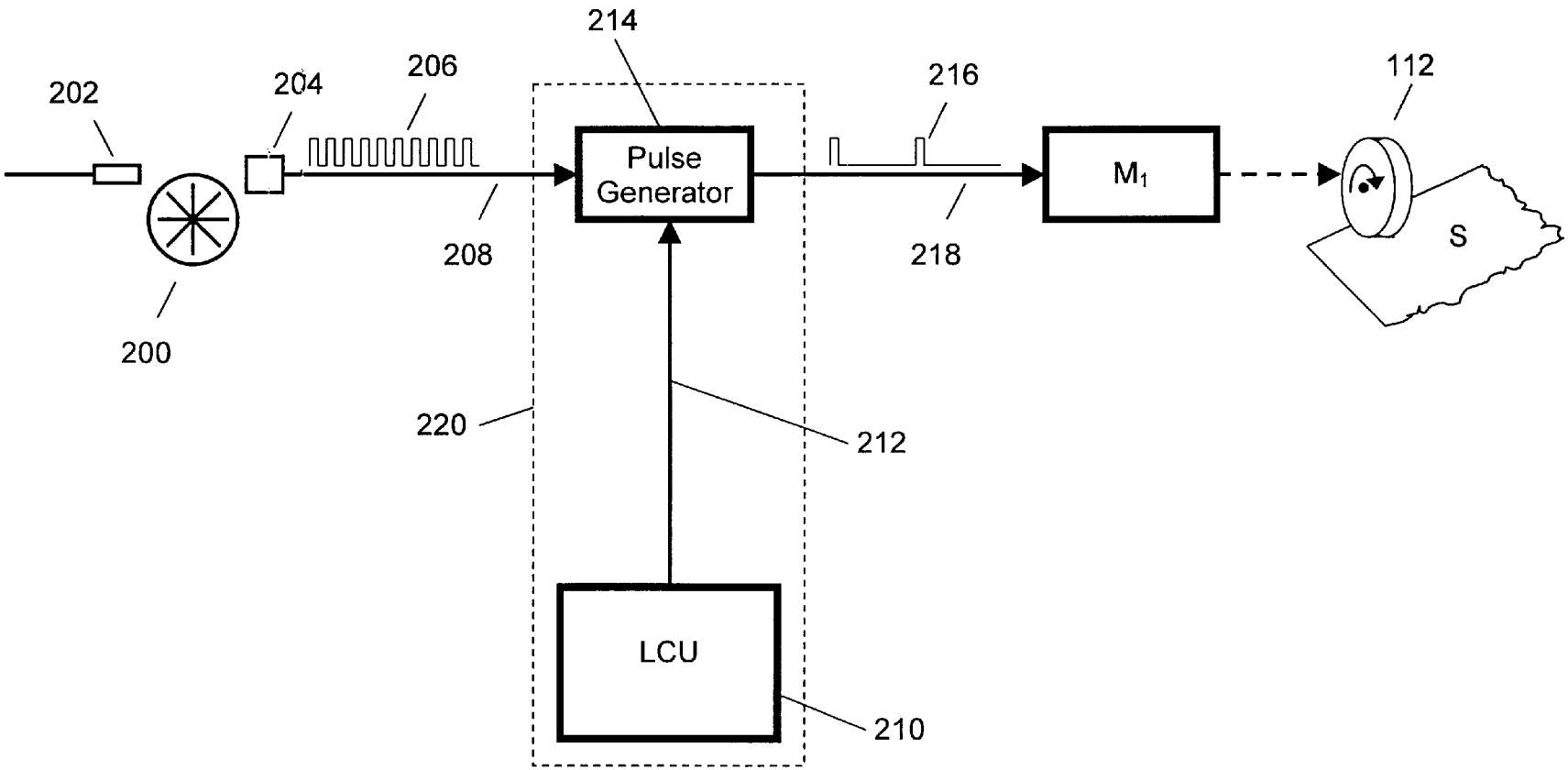
FIG. 8 is a schematic of a circuit for controlling one or more stepper motors in accordance with one embodiment of the invention.

In order to effect the desired skew removal, and cross-track and in-track sheet alignment, the mechanical elements of the sheet registration mechanism 100 according to this invention are operatively associated with a controller 220 (see FIG. 8). The controller 220 receives input signals from a plurality of sensors associated with the sheet registration mechanism 100 and a downstream operation station. Based on such signals and an operating program, the controller 220 produces appropriate signals to control the independent stepper motors $M_1$, $M_2$, and $M_3$ of the sheet registration mechanism.

For the operation of the sheet registration mechanism 100, referring now particularly to FIGS. 5, 6 and 7*a*–7*f*, a sheet S traveling along the transport path P is moved into the vicinity of the sheet registration mechanism by an upstream transport assembly including non-separable nip rollers (not shown). Such sheet may be oriented at an angle (e.g., angle a in FIG. 5) to the centerline $C_L$ of the path P and may have its center A spaced a distance from the path centerline (e.g., distance d in FIG. 5). The angle $\alpha$ and distance d, which are undesirable, are of course generally induced by the nature of the upstream transport assembly and are variable sheet-to-sheet.

Figure 5:
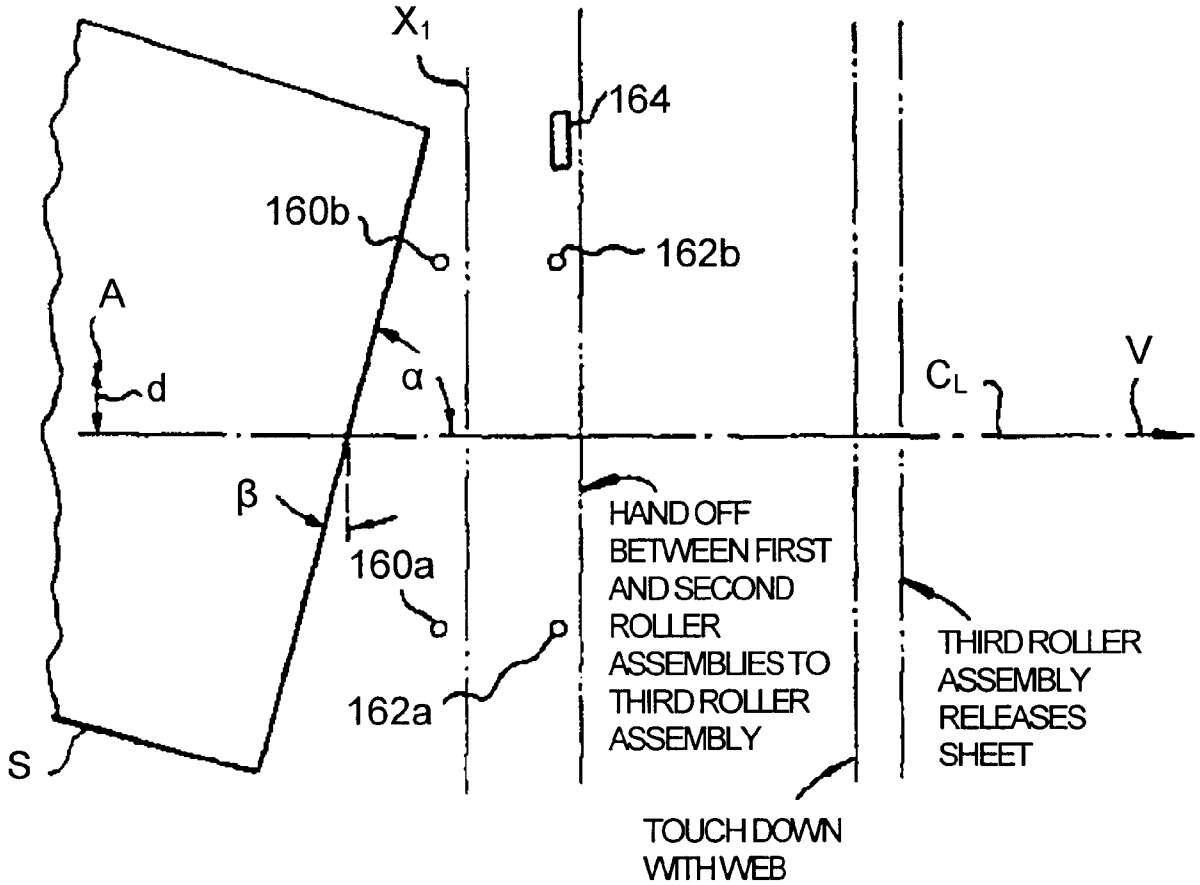
FIG. 5 is top schematic illustration of the sheet transport path showing the actions of the sheet registration mechanism of FIG. 1 on an individual sheet as it is transported along a transport path.

A pair of nip sensors 160*a*, 160*b* is located upstream of the plane $X_1$ (see FIG. 5). The plane $X_1$ is defined as including the longitudinal axes of the urging rollers (112, 122, 132) and the rollers of the idler roller pairs (154, 156). The nip sensors 160*a*, 160*b* may, for example, be of either the optical or mechanical type. Nip sensor 160*a* is located to one side (in the cross-track direction) of the centerline $C_L$, while nip sensor 160*b* is located a substantially equal distance to the opposite side of the centerline $C_L$.

When the sensor 160*a* detects the lead edge of a sheet transported along the path P, it produces a signal which is sent to the controller 220 for the purpose of activating the first stepper motor $M_1$. In a like manner, when the sensor 160*b* detects the lead edge of a sheet transported along the path P, it produces a signal which is sent to the controller 220 for the purpose of activating the second stepper motor $M_2$. If the sheet S is at all skewed relative to the path P, the lead edge to one side of the centerline $C_L$ will be detected prior to detection of the lead edge at the opposite side of the centerline (of course, with no skew, the lead edge detection at opposite sides of the centerline will occur substantially simultaneously).

Figure 6:
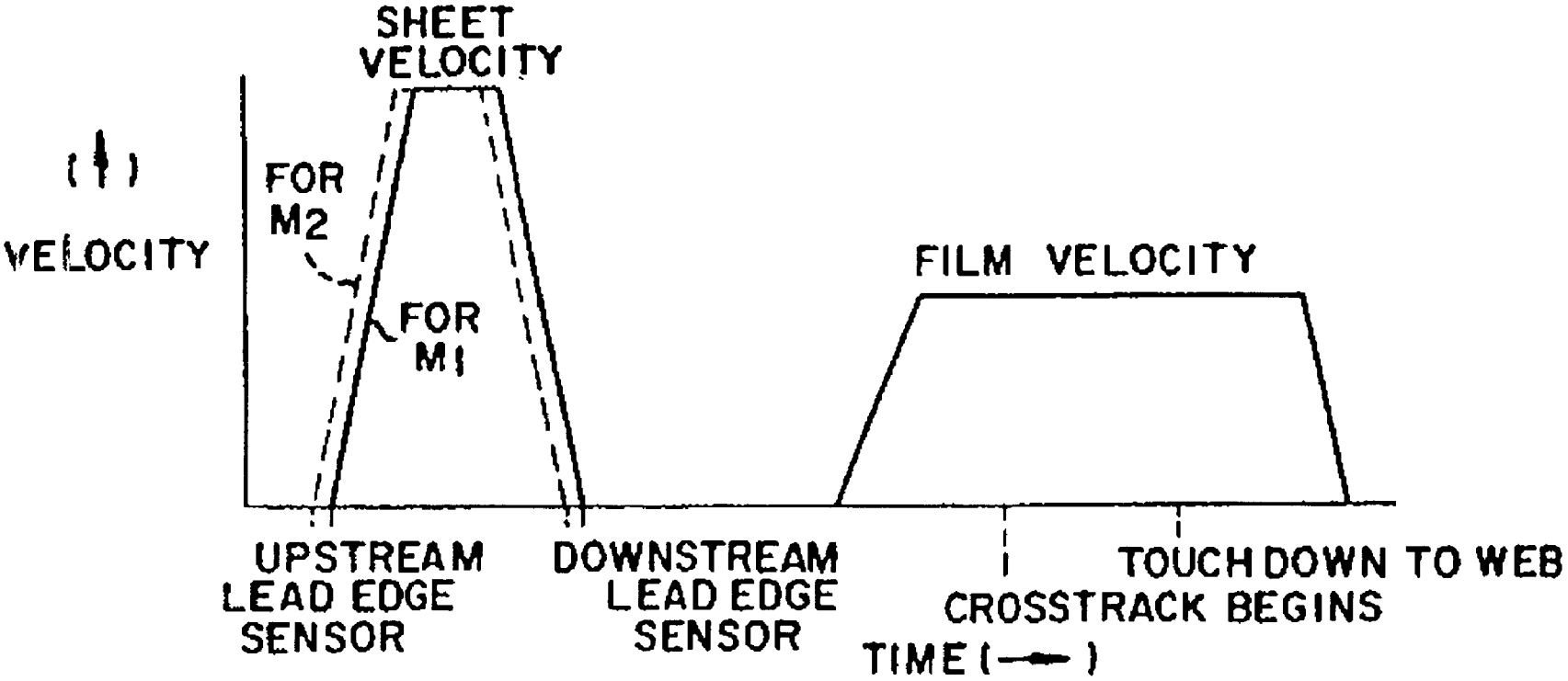
FIG. 6 is a graphical representation of the peripheral velocity profile over time for the urging rollers of the sheet registration mechanism of FIG. 1.

As shown in FIG. 6, when the first stepper motor $M_1$ is activated by the controller 220, it will ramp up to a speed such that the first urging roller 112 will be rotated at an angular velocity to yield a predetermined peripheral speed for the arcuate peripheral segment 112*a* of such roller substantially equal to the entrance speed of a sheet transported along the path P. When the portion of the sheet S enters the nip between the arcuate peripheral segment 112*a* of the first urging roller 112 and the associated roller of the idler roller pair 154, such sheet portion will continue to be transported along the path P in a substantially uninterrupted manner (see FIG. 7*b*).

Likewise, when the second stepper motor $M_2$ is activated by the controller 220, it will ramp up to a speed such that the second urging roller 122 will be rotated at an angular velocity (substantially the same as the angular velocity of the first urging roller) to yield a predetermined peripheral speed for the arcuate peripheral segment 122*a* of such roller substantially equal to the speed of a sheet transported along the path P. When the portion of the sheet S enters the nip between the arcuate peripheral segment 122*a* of the second urging roller 122 and the associated roller of the idler roller pair 154, such sheet portion will continue to be transported along the path P in a substantially uninterrupted manner. As seen in FIG. 5, due to the angle a of the sheet S, sensor 160*b* will detect the sheet lead edge prior to the detection of the lead edge by the sensor 160*a*. Accordingly, the stepper motor $M_2$ will be activated prior to activation of the motor $M_1$.

A pair of in-track sensors 162*a*, 162*b* is located downstream of the plane $X_1$. As such, the in-track sensors 162*a*, 162*b* are located downstream of the nips formed respectively by the arcuate peripheral segments 112*a*, 122*a* and their associated rollers of the idler roller pairs 154. Thus, the sheet S will be under the control of such nips. The in-track sensors 162*a*, 162*b* may, for example, be of either the optical or mechanical type. Sensor 162*a* is located to one side (in the cross-track direction) of the centerline $C_L$, while sensor 162*b* is located a substantially equal distance to the opposite side of the centerline $C_L$.

When the sensor 162*a* detects the lead edge of a sheet transported along the path P by the urging roller 112, it produces a signal which is sent to the controller 220 for the purpose of deactivating the first stepper motor $M_1$. In a like manner, when the sensor 162*b* detects the lead edge of a sheet transported along the path P by the urging roller 122, it produces a signal which is sent to the controller 220 for the purpose of deactivating the second stepper motor $M_2$. Again, if the sheet S is at all skewed relative to the path P, the lead edge at one side of the centerline $C_L$ will be detected prior to detection of the lead edge at the opposite side of the centerline.

When the first stepper motor $M_1$ is deactivated by the controller 220, its speed will ramp down to a stop such that the first urging roller 112 will have zero angular velocity to stop the engaged portion of the sheet in the nip between the arcuate peripheral segment 112*a* of the first urging roller 112 and the associated roller of the idler roller pair 154 (see FIG. 7*c*). Likewise, when the second stepper motor $M_2$ is deactivated by the controller 220, its speed will ramp down to a stop such that the first urging roller 112 will have zero angular velocity to stop the engaged portion of the sheet in the nip between the arcuate peripheral segment 122*a* of the second urging roller 122 and the associated roller of the idler roller pair 154. Again referring to FIG. 5, due to the angle $\alpha$ of the sheet S, sensor 162*b* will detect the sheet lead edge prior to the detection of the lead edge by the sensor 162*a*. Accordingly, the stepper motor $M_2$ will be deactivated prior to deactivation of the motor $M_1$. Therefore, the portion of the sheet in the nip between the arcuate peripheral segment 122*a* of the second urging roller 122 and the associated roller of the idler roller pair 154 will be held substantially fast (i.e., will not be moved in the direction along the transport path P) while the portion of the sheet in the nip between the arcuate peripheral segment 112*a* of the first urging roller 112 and the associated roller of the idler roller pair 154 continues to be driven in the forward direction. As a result, the sheet S will rotate substantially about its center A until the motor $M_1$ is deactivated. Such rotation, through an angle $\beta$ (substantially complementary to the angle $\alpha$) will square up the sheet and remove the skew in the sheet relative to the transport path P to properly align the lead edge thereof.

The in-track sensor 162*a* and/or 162*b* establishes a known position of the receiver by sensing the receiver, for example a leading edge. A set of stepper motor pulses may be sent to the stepper motors to establish a known position downstream from the in-track sensor 162*a* and/or 162*b* since a set of stepper motor pulses sent to the stepper motors moves the receiver a fixed distance, an inherent property of stepper motors and the geometry of the urging rollers.

Once the skew has been removed from the sheet, as set forth in the above description of the first portion of the operative cycle of the sheet registration mechanism 100, the sheet is ready for subsequent cross-track alignment and registered transport to a downstream location. A sensor 164, such as a set of sensors (either optical or mechanical as noted above with reference to other sensors of the registration mechanism 100) aligned in the cross-track direction (see FIG. 5), detects a lateral marginal edge of the sheet S and produces a signal indicative of the location thereof.

The signal from the sensor 164 is sent to the controller 220 where the operating program will determine the distance (e.g., distance d shown in FIG. 5) of the center A of the sheet from the centerline $C_L$ of the transport path P. At an appropriate time determined by the operating program, the first stepper motor $M_1$ and the second stepper motor $M_2$ will be activated. The first urging roller 112 and the second urging roller 122 will then begin rotation to start the transport of the sheet toward the downstream direction (see FIG. 7*d*). The stepper motors will ramp up to a speed such that the urging rollers of the roller assemblies 102, 104, and 106 will be rotated at an angular velocity to yield a predetermined peripheral speed for the respective portions of the arcuate peripheral segments thereof Such predetermined peripheral speed is, for example, substantially equal to the speed of the web W. While other predetermined peripheral speeds are suitable, it is important that such speed be substantially equal to the speed of the web W when the sheet S touches down at the web.

Of course, in view of the above coupling arrangement for the third roller assembly 106, rotation of the third urging rollers 132 will also begin when the first stepper motor Ml is activated. As will be appreciated from FIGS. 7*a*–7*d*, up to this point in the operative cycle of the sheet registration mechanism 100, the arcuate peripheral segments 132*a* of the third urging rollers 132 are out of contact with the sheet S and have no effect thereon. Now the arcuate peripheral segments 132*a* engage the sheet (in the nip between the arcuate peripheral segments 132*a* and the associated rollers of the idler roller pair 156) and, after a degree of angular rotation, the arcuate peripheral segments 112*a* and 122*a* of the respective first and second urging rollers leave contact with the sheet (see FIG. 7*e*). The control over the sheet is thus handed off from the nips established by the arcuate peripheral segments of the first and second urging rollers and the idler roller pair 154 to the arcuate peripheral segments of the third urging rollers and the idler roller pair 156 such that the sheet is under control of only the third urging rollers 132 for transport of the sheet along the path P.

At a predetermined time, once the sheet is solely under the control of the third urging rollers 132, the controller 220 activates the third stepper motor $M_3$. Based on the signal received from sensor 164 and the operating program of the controller 220, the stepper motor $M_3$ will drive the third roller assembly 106, through the above-described belt and pulley arrangement 138, in an appropriate direction and for an appropriate distance in the cross-track direction. Accordingly, the sheet in the nips between the arcuate peripheral segments of the third urging rollers 132 and the associated rollers of the idler roller pair 156 is urged in a cross-track direction to a location where the center A of the sheet coincides with the centerline $C_L$ of the transport path P to provide for the desired cross-track alignment of the sheet.

The third urging rollers 132 continue to transport the sheet along the transport path P at a speed substantially equal to the speed of the web W until the lead edge touches down on the web, in register with the image I carried by the web. At this point in time, the angular rotation of the third urging rollers 132 brings the arcuate peripheral segments 132*a* of such rollers out of contact with the sheet S (see FIG. 7*f*). Since the arcuate peripheral segments 112*a* and 122*a* of the respective first and second urging rollers 112 and 122 are also out of contact with the sheet, such sheet is free to track with the web W undisturbed by any forces which might otherwise have been imparted to the sheet by any of the urging rollers.

At the time the first, second and third urging rollers are all out of contact with the sheet, the stepper motors $M_1$, $M_2$, and $M_3$ are activated for a time, dependent upon signals to the controller 220 from the respective sensors 118, 128, and 150, and then deactivated. As described above, such sensors are home position sensors. Accordingly, when the stepper motors are deactivated, the first, second, and third urging rollers are respectively located in their home positions. Therefore, the roller assemblies 102, 104, 106 of the sheet registration mechanism 100 according to this invention are located as shown in FIG. 7*a*, and the sheet registration mechanism is ready to provide skew correction and cross-track and in-track alignment for the next sheet transported along the path P.

As noted above, a problem with the registration control mechanism of known systems is that control of the stepper motor drives during ramp-up of the sheet speed is not synchronized with exact movement of the web. Because the web speed changes, improved registration requires that control of the drive to the sheet be synchronized with the movement of the web. The synchronization method of U.S. Pat. No. 5,731,680 achieves synchronization through use of an encoder associated with the transfer roller R. The encoder produces an output of electrical pulses that are synchronized with the movement of the transfer roller R. The encoder pulses are used to drive the urging rollers 112, 122 once the sheet S has been ramped up to a speed approximately equal to that of the moving web W. However, due to the limited precision of the encoder output, a separate high-frequency timer must be used to drive the urging rollers 112, 122 during ramp-up and synchronization with the encoder output. Moreover, the limited precision of the encoder output results in a margin of error of up to one step of the stepper motor during the skew correction and in-track alignment process. The improved registration method of the current invention reduces the margin of error by driving all stages of the registration process with an encoder having a higher resolution.

With reference to FIG. 8, a schematic of one form of a stepper motor controller for use in the apparatus and method of the invention is illustrated. An encoder wheel 200 is provided that is associated with the transfer roller R (FIG. 1) and as the roller rotates, the indicia on the encoder wheel move and interrupt light from a light source 202, which light or absence of same is sensed by a phototransducer 204. Other forms of encoders that use magnetic indicia or are linear rather than rotating may be used since the encoder details are not critical to the invention. Electrical pulses 206 are generated by the phototransducer on line 208 and these pulses are synchronized with movement of the transfer roller 9 and the moving web W. The logic and control unit LCU 210, which may be a microprocessor functioning in accordance with an operating program, commences a programmed control over line 212 of a programmable pulse generator 214 that generates a series of stepper motor pulses 216 over a line 218. Collectively, the LCU 210 and the pulse generator 214 may constitute a registration system controller 220.

As described above, the stepper motor Ml is mechanically coupled by a drive coupling to a drive member such as the first drive roller 112 that is in engagement with the receiver sheet S. The second stepper motor is similarly connected to the second drive roller for providing similar drive to the sheet S. The programmed drive of the stepper motors, as will be more fully described below, is provided to correct any skew in the sheet, to drive the sheet to a speed approximate to that of the image-bearing member, and to deliver the sheet to the image-bearing member at the proper time to ensure accurate in-track registration. A third stepper motor is provided for driving the third roller assembly for obtaining cross-track registration as noted above.

In one presently preferred embodiment of the invention, a programmable timer may serve as the pulse generator. This embodiment will now be discussed with reference to the schematic of FIG. 9 and the flowchart of FIG. 10.

Figure 9:
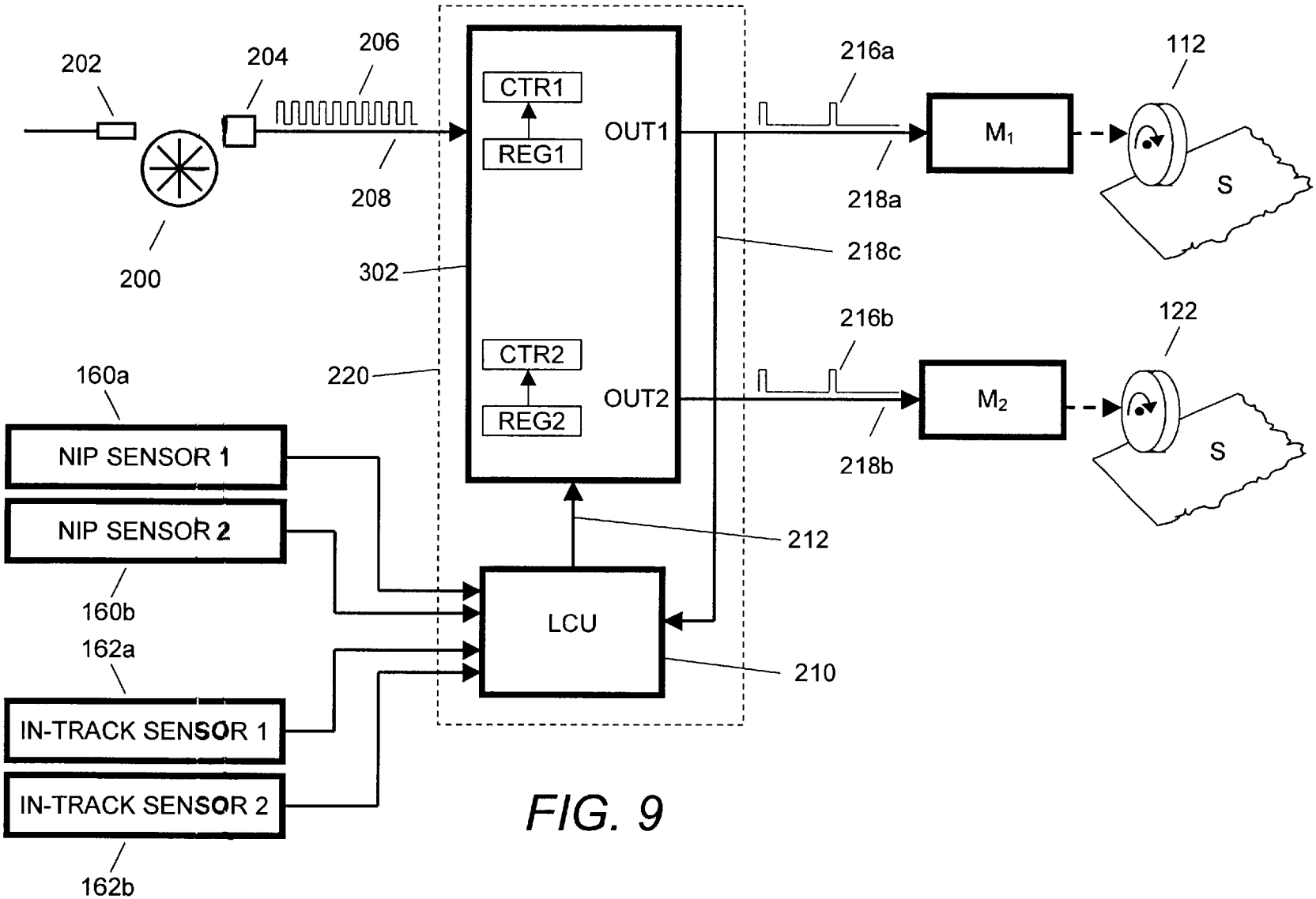
FIG. 9 is a schematic of a second circuit for controlling stepper motors in accordance with a second embodiment of the invention.

With reference to FIG. 9, there is shown a schematic of one presently preferred embodiment of the invention wherein a registration system controller 220 includes a programmable timer 302, such as a 9513 System Timing Controller manufactured by Advanced Micro Devices, or the equivalent. Attached as an Appendix A is an ASIC Specification for a system timing controller suitable for use with the present invention. Two output lines, Out 1, Out 2 are associated with the timer. Line Out 1 is connected to a drive input of a first stepper motor M1 via line 218*a*. Similarly, line Out 2 is connected to a drive input of a second stepper motor M2 via line 218*b*. The timer includes at its input a line 208 which carries encoder pulses 206 that are generated in synchronism with rotation of the transfer roller R as described above.

The timer 302 is controlled via line 212 by the LCU 210. The LCU 210 includes a central processing unit, memory and various attendant input/output devices for communicating control data to the timer 302. The LCU receives input data from nip sensors 160*a*, 160*b* and in-track sensors 162*a*, 162*b*. The timer includes a first register (REG1) and a first counter (CTR1) that is associated with the register. In order to generate stepper motor pulses that are spaced at programmed intervals, it is known to provide a programmed count value that is stored in a counter. The counter then counts high speed clock pulses and when it matches the count, a single stepper motor drive pulse is generated. Typically, the counts may work by downcounting the number of clock pulses starting with the count value until zero is reached before emitting the stepper motor drive pulse. A new count value is then loaded into the counter from the associated register which in turn receives the count from the LCU. The counting process repeats for generating the next stepper motor drive pulse. By changing the count values a programmed series of stepper motor drive pulses may be generated at non-uniform intervals. Uniform intervals of stepper motor drive pulses may be provided by either retaining the same count value in the counter or the register or continually reloading the same count value from the LCU to the associated register which stores the count value and is used to load or preset the counter. The programmable counter (CTR1) is responsive to encoder pulses 206 from the transducer 204 on line 208. The series of stepper motor drive pulses generated by the counter (CTR1) are output on line Out 1. A second register (REG2) and second programmable counter (CTR2) are also provided for counting encoder pulses on line 208. Because register (REG2) can be loaded with different count values by the LCU, the stepper motor pulses generated by the second counter (CTR2) may be of different spacing when output on line Out 2 from those output on line Out 1. The LCU controls the timer 302 by providing appropriate count values for controlling the stepper motors $M_1$, $M_2$. The timer 302 counts down from each count value provided by the LCU 210, then emits a stepper motor drive pulse on the appropriate output line. In generating stepper motor drive pulses responsive to encoder pulse the timer 302 is set in a mode wherein the rising edge of the appropriate encoder pulse on line 208 generates a stepper motor pulse on an output line such as Out 1.

Figure 10:
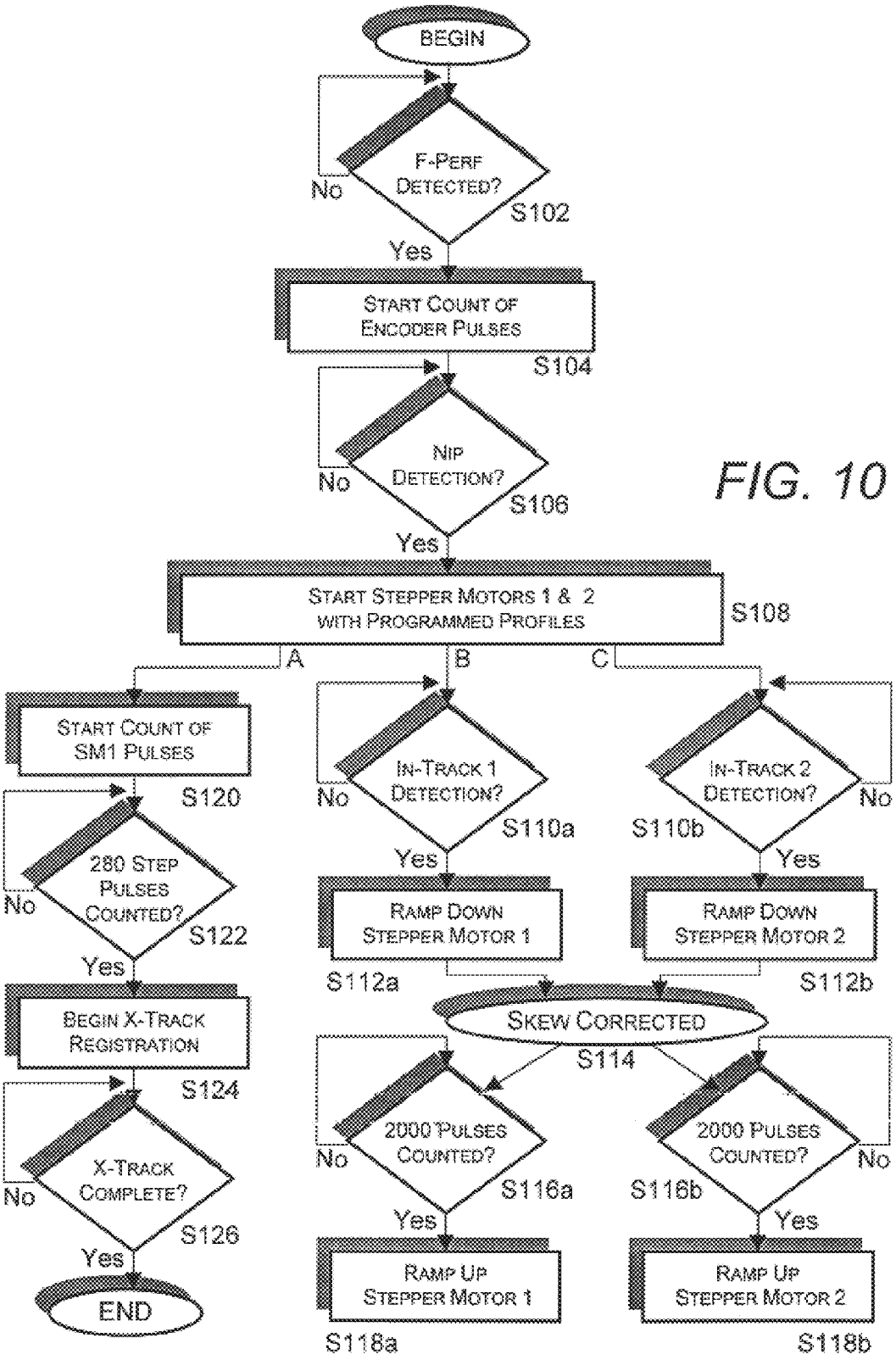
FIG. 10 is a flowchart describing operation of the circuit of FIG. 9.

The operation of this presently preferred embodiment of the invention will now be discussed with reference to FIG. 10. Initially, an encoder index pulse signal (F-PERF) is detected (step S102) and a count is commenced (S104) of encoder pulses in a counter associated with the LCU. In step S106, the receiver sheet has been transported or fed into the skew registration device 10 and a determination is made in response to the nip sensors 160*a*, 160*b* as to whether or not the sheet is detected. Upon detection of a sheet, the two stepper motors $M_1$, $M_2$ are activated to run in accordance with programmed profiles (step S108). As described above, the stepper motors may be run with a controlled profile by having the LCU input different count values into registers provided in the programmable timer 302. When a count value is loaded into one of the timer's counter registers, a counter in the timer counts the encoder pulses and decrements the count in the register. Upon the count in the register reaching zero, an output pulse is provided on the appropriate output line which serves as a pulse to drive the corresponding stepper motor. At this time, a new count may be then loaded into the register. As this is repeated, a controlled series of stepper motor drive pulses 216*a*, 216*b* at predetermined time spacings may be generated by selecting the individual count values that are placed in the register through signals from the LCU. Other means for generating-non-uniformly spaced pulses are known. For example, a shift register may be provided with a programmed series of digital ones and zeros as data. In this example, the LCU may generate clock pulses that are used to shift the data from the register onto the shift register's output line that is connected to the stepper motor. The digital one values, for example, may serves as stepper motor drive pulses.

The LCU is programmed to load serially into each of the registers a predetermined set of digital numbers representing count values. These numbers may be serially loaded into each register which is known to activate each stepper motor to provide a drive profile that will cause a receiver sheet to be advanced within the registration device. Each stepper motor $M_1$, $M_2$ is driven independently of the other, with stepper motor $M_1$ being driven by pulses on the timer's output line Out 1 to which stepper motor $M_1$ is connected. The output on line Out 1 is generated by pulses produced by the counter (CTR1) that is programmed with count values stored in the register (REG1). Similarly, stepper motor $M_2$ is driven by step pulses on the timer's output line Out 2 to which stepper motor $M_2$ is connected. The output on line Out 2 is generated by pulses produced by the counter (CTR2) that is programmed with count values stored in the register (REG2).

When the lead edge of the receiver sheet is detected by the in-track sensors 162*a*, 162*b*, a signal is generated to the LCU (step S110*a*, S110*b*). In response to this signal, a set of programmed count values is then serially placed in the appropriate timing register to cause a series of pulses on the corresponding stepper motor drive line, i.e., either 118*a* or 118*b*, thereby causing a ramp down speed profile effect to be generated to stop the respective stepper motor (step S112*a*, S112*b*). When both stepper motors are stopped, the sheet has been corrected for skew to within one stepper motor drive step (step S114). The system is then prepared to ramp the sheet up to the approximate speed of the moving web W. Ramping to web speed begins a predetermined number of encoder pulses after the initial detection of F-PERF. By way of example, this predetermined number may be 2000 encoder pulses. The predetermined value is stored in non-volatile memory within the LCU 210. When the LCU has detected (steps S116*a*, S116*b*) the predetermined number of pulses after F-PERF, a set of programmed count values is serially placed in the appropriate timing registers to cause a series of pulses on the corresponding stepper motor drive lines 118*a*, 118*b*, thereby causing the stepper motors $M_1$, $M_2$ to ramp up movement (steps S118*a*, S118*b*) of the receiver sheet S to web speed. For example, a series of four count values may be used to ramp the sheet S to film speed. The fourth and final value that is loaded into each of the counter registers is five, which will cause a stepper motor pulse to be generated after five encoder pulses. At this rate, the sheet S advances at approximately the speed of the moving web W. The count value of five is then retained, causing the timer to generate a series of uniformly spaced stepper motor drive pulses because the counter is continually downcounting the count of encoder pulses starting at the same count value and emitting a stepper motor drive pulse when reaching zero. Thus, the stepper motors $M_1$, $M_2$ are driven to maintain a speed of the sheet S that approximates that of movement of the image I on the photoconductive web. The registration assembly maintains this drive speed until the sheet S is delivered to the image-bearing member.

Cross-track registration is provided along an independent logic flow path. As may be seen in step S120, a count is commenced of step pulses to stepper motor $M_1$. When 280 step pulses are counted (step S122) drive by a third stepper motor to the third drive roller assembly is provided to begin cross-track registration (step S124). This typically would be expected to occur after steps S118*a*, S118*b*. Correction of cross-track registration (steps S126) would be completed prior to the sheet engaging the moving web W.

Figure 11:
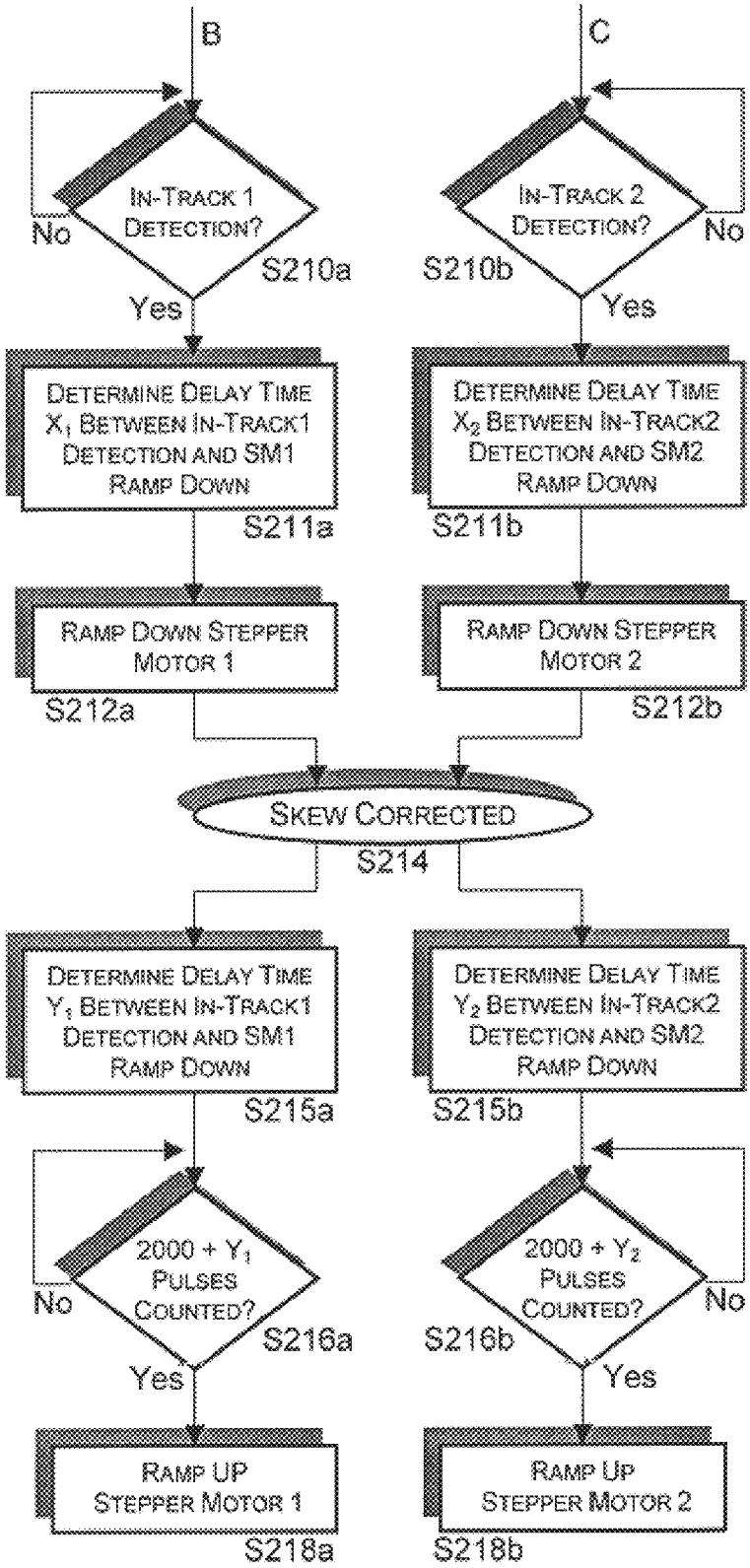
FIG. 11 is a flowchart further describing operation of the circuit of FIG. 9.

Yet another presently preferred embodiment of the present invention reduces the margin of error in the registration process by accounting for potential over-correction in the de-skewing stage. As described above, skew correction is accomplished by ramping down the stepper motors $M_1$, $M_2$ after detection of the lead edge of the sheet by the in-track sensors 162*a*, 162*b*. The ramp-down is accomplished in an integral number of steps of each stepper motor, each step occurring during a programmed number of encoder pulses. Because each step of a stepper motor requires a finite amount of time (approximately equal to the duration of five encoder pulses), it is possible for in-track detection to occur during a step. However, the ramp-down program will not initiate until the beginning of the next step. In such a case, the sheet S travels a fraction of a step past the optimal stopping point. This may result in residual skew and positional or timing errors that remain uncorrected. This problem is addressed by determining the difference in time between in-track detection and the actual initiation of the ramp-down program. The ramp-up program is then delayed by an appropriate amount of time to account for the error. This process is discussed in further detail with reference to the flowchart of FIG. 11.

When the in-track sensors 162*a*, 162*b* detect (steps S210*a*, S210*b*) the lead edge of the receiver sheet S, the LCU 210 starts a high-frequency timer to determine the amount of time between in-track detection and the beginning of the next stepper motor drive step, which is coincident with initiation of the ramp-down program (steps S212*a*, S212*b*). The delay-timing step (S211*a*, S211*b*) is performed independently for each of the stepper motors $M_1$, $M_2$. The amount of delay time is then converted (steps S215*a*, S215*b*) to an integral number of encoder pulses. The number $Y_1$, $Y_2$ of encoder pulses is determined independently for each of the stepper motors $M_1$, $M_2$ respectively. The appropriate number $Y_1$, $Y_2$ of corrective encoder pulses is then added to the delay counter for each stepper motor in steps S216*a*, S216*b*, so as to further delay initiation of the ramp-up program (steps S218*a*, S218*b*) by an additional $Y_1$ or $Y_2$encoder pulses. For example, the period of time between successive stepper motor drive pulses 216 may be 253 microseconds. This corresponds to five consecutive encoder pulses. Conversely, each encoder pulse corresponds to one quintile of a stepper motor drive pulse period, or approximately 50 microseconds. Accordingly, the following associations between delay times and corresponding number $Y_1$, $Y_2$ of corrective encoder pulses may be established:

| Delay Time | Y Value |
|---|---|
| 0–50 microseconds | 1 encoder pulse |
| 51–100 microseconds | 2 encoder pulses |
| 101–150 microseconds | 3 encoder pulses |
| 151–200 microseconds | 4 encoder pulses |
| 201–253 microseconds | 5 encoder pulses |

By delaying the ramp-up program in this way, the registration mechanism compensates for variation between in-track detection and initiation of the ramp-down program, thereby further increasing the precision of both skew correction and in-track alignment.

Although the invention is described with specific reference to electrophotographic apparatus and methods, the invention has broader applicability to other fields wherein registration of a moving sheet is to be made with an image-bearing member.

The invention has been described in detail with particular reference to preferred embodiments thereof and illustrative examples, but it will be understood that variations and modifications can be effected within the spirit and scope of the invention.

What is claimed is:

1. An apparatus for advancing a receiver into registered relationship with a moving image-bearing member, the image-bearing member moving at an image-bearing member speed, the apparatus comprising:

a motor that is responsive to motor drive pulses;

a drive member operative to engage the receiver;

a drive coupling connecting the motor and the drive member;

an encoder operative to generate encoder pulses that correspond with movement of the image-bearing member; and a pulse generator operative to generate motor drive pulses, the pulse generator being connected to the motor and generating motor drive pulses in response to the encoder pulses and operative to accelerate the receiver from a stop to a speed approximately equal to an image-bearing member speed.

2. An apparatus for advancing a receiver into registered relationship with a moving image-bearing member as in claim 1, further comprising:

a timer operative to determine an amount of delay time between a detection of the receiver by an in-track sensor and the beginning of a subsequent movement of the motor; and a delay mechanism operative to delay the acceleration of the receiver to the approximate image-bearing member speed by the amount of delay time.

3. An apparatus for advancing a receiver into registered relationship with a moving image-bearing member as in claim 1, wherein:

the motor is a stepper motor configured to drive the drive member in a plurality of steps.

4. An apparatus for advancing a receiver into registered relationship with a moving image-bearing member as in claim 1, wherein:

the receiver is a cut sheet of paper or transparency material.

5. A receiver registration mechanism for aligning a receiver moving along a transport path relative to an image-bearing member moving at an image-bearing member speed, the receiver registration mechanism comprising:

an encoder operative to track the movement of the image-bearing member;

a roller assembly rotatable about an axis;

a motor operative to drive the roller assembly to advance the receiver along the transport path; and the motor being driven in accordance with an output from the encoder to ramp the receiver from a stop to a velocity substantially equal to the image-bearing member speed.

6. A receiver registration mechanism for aligning a receiver moving along a transport path relative to an image-bearing member moving at an image-bearing member speed, the receiver registration mechanism comprising:

an encoder operative to track the movement of the image-bearing member;

a roller assembly rotatable about an axis;

a motor operative to drive the roller assembly to advance the receiver along the transport path; and a microprocessor operative to receive an input signal from the encoder and to drive the motor in accordance with the encoder input signal to accelerate movement of the receiver from a stop to a speed substantially equal to the image-bearing member speed.

7. A receiver registration mechanism as in claim 6, further comprising:

a sensor operative to detect a lead edge of the receiver as it arrives at the receiver registration mechanism; and wherein the microprocessor is operative to receive a sensor input signal from the sensor, determine a time between detection of the lead edge of the receiver and a subsequent movement of the motor based upon the sensor input signal, and delay the driving of the motor for the determined amount of time.

8. A receiver registration mechanism for aligning a receiver moving along a transport path relative to an image-bearing member moving at an image-bearing member speed, the receiver registration mechanism comprising:

an encoder operative to track the movement of the image-bearing member;

a roller assembly rotatable about an axis;

a motor operative to drive the roller assembly to advance the receiver along the transport path; and first means for driving the motor in response to an output of the encoder to accelerate the receiver movement from a stop to a velocity substantially equal to the image-bearing member speed.

9. A receiver registration mechanism as in claim 8, further comprising:

a sensor operative to detect a lead edge of the receiver as it arrives at the receiver registration mechanism;

a timer operative to receive an input signal from the sensor and to, determine an, amount of time between detection of the lead edge of the receiver and a subsequent movement of the motor; and means for delaying the driving of the roller assembly by the determined amount of time.

10. A method for moving a receiver into registered relationship with an image-bearing member, the image-bearing member moving at an image-bearing member speed, the method comprising the steps of:

providing an encoder that tracks the movement of the image-bearing member;

providing a motor; and driving the motor in response to an output of the encoder to accelerate the receiver movement from a stop to a speed substantially equal to the image-bearing member speed.

11. A method for registering a receiver as in claim 10, further comprising the steps of:

detecting a lead edge of the receiver;

determining an amount of time between the detection of the lead edge of a receiver and a subsequent movement of the motor; and delaying the step of driving the motor by the determined amount of time.

12. An apparatus for advancing a receiver into registered relationship with a moving image-bearing member, the image-bearing member moving at an image-bearing member speed, the apparatus comprising:

a motor that is responsive to motor drive pulses;

a drive member operative to engage the receiver;

a drive coupling connecting the motor and the drive member;

an in-track sensor operative to establish a known position;

an encoder operative to generate encoder pulses that correspond with movement of the image-bearing member; and a pulse generator operative to generate motor drive pulses, the pulse generator being connected to the motor and generating motor drive pulses in response to the encoder pulses that are operative to transport the receiver from the known position to the image-bearing member.

13. An apparatus for advancing a receiver into registered relationship with a moving image-bearing member as in claim 12, further comprising:

a timer operative to determine an amount of delay time between a detection of the receiver by an in-track sensor and the beginning of a subsequent movement of the motor; and a delay mechanism operative to delay the acceleration of the receiver to the approximate image-bearing member speed by the amount of delay time.

14. An apparatus for advancing a receiver into registered relationship with a moving image-bearing member as in claim 12, wherein:

the motor is a stepper motor configured to drive the drive member in a plurality of steps.

15. An apparatus for advancing a receiver into registered relationship with a moving image-bearing member as in claim 12, wherein:

the receiver is a cut sheet of paper or transparency material.

16. A method for moving a receiver into registered relationship with an image-bearing member, the image-bearing member moving at an image-bearing member speed, the method comprising the steps of:

generating encoder pulses with an encoder that tracks the movement of the image-bearing member;

establishing-a known position of the receiver using an in-track sensor;

transporting the receiver from the known position to the image bearing member with a motor in response to the encoder pulses.

17. A method for registering a receiver as in claim 16, wherein the step of establishing a known position of the receiver comprises detecting a lead edge of the receiver.

18. A method for registering a receiver as in claim 16, further comprising the steps of:

detecting a lead edge of the receiver;

determining an amount of time between the detection of the lead edge of a receiver and a subsequent movement of the motor; and delaying the step of driving the motor by the determined amount of time.

* * * * *

Disclaimer

6,641,134 — Michael T. Dobbertin, Honeoye, NY; Timothy J. Young, Williamson, NY. SYSTEM AND METHOD FOR IMPROVED REGISTRATION PERFORMANCE. Patent dated Nov. 04, 2003. Disclaimer filed April 19, 2004, by the assignee, Heidelberg Druckmaschinen AG.

The term of this patent subsequent to February 26, 2021, has been disclaimed.

*(Official Gazette May 24, 2005)*